US008495964B1

(12) United States Patent
Ronald

(10) Patent No.: US 8,495,964 B1
(45) Date of Patent: Jul. 30, 2013

(54) ELASTIC ANCHOR ROPE

(76) Inventor: Kubli N Ronald, Saint Petersburg, FL (US)

( * ) Notice: Subject to any disclaimer, the term of this patent is extended or adjusted under 35 U.S.C. 154(b) by 109 days.

(21) Appl. No.: 13/274,311

(22) Filed: Oct. 15, 2011

Related U.S. Application Data

(63) Continuation-in-part of application No. 12/287,643, filed on Oct. 14, 2008, now abandoned.

(51) Int. Cl.
*B63B 21/00* (2006.01)

(52) U.S. Cl.
USPC ..... 114/230.2; 114/293

(58) Field of Classification Search
USPC ..... 87/2, 6, 8, 9; 267/69; 114/293, 230.22, 114/213, 230.2; 24/300
See application file for complete search history.

(56) References Cited

U.S. PATENT DOCUMENTS

| | | | |
|---|---|---|---|
| 3,931,656 | A | 1/1976 | Thomson |
| 4,044,415 | A | 8/1977 | Wood |
| 5,483,911 | A | 1/1996 | Kubli |
| 6,202,263 | B1 | 3/2001 | Harker |
| 2005/0061223 | A1 | 3/2005 | Scott |

*Primary Examiner* — Edwin Swinehart
(74) *Attorney, Agent, or Firm* — David Kiewit

(57) ABSTRACT

An elastic anchor rope has an elastomeric core over most of its length. The core stretches during mooring to permit discharge of persons and items such as on a beach with subsequent retraction of the craft to an offshore location. A bow line permits retraction of the craft to the beach for loading purposes. Tensile loads are transferred from the elastomeric core to an intermediate cord and from the cord to end portions of the rope that do not have the core.

13 Claims, 2 Drawing Sheets

ELASTIC ANCHOR ROPE

CROSS REFERENCE TO RELATED APPLICATIONS

This application is a continuation-in-part of the inventor's U.S. application Ser. No. 12/287,643 filed Oct. 14, 2008, now abandoned.

BACKGROUND INFORMATION

The present invention pertains generally to an anchor rope for mooring small watercraft as disclosed in U.S. Pat. No. 5,483,911 issued to the present inventor and incorporated herein by reference.

BRIEF SUMMARY OF THE INVENTION

The present invention is directed toward a rope for the temporary mooring of small watercraft offshore to avoid damage to the boat hull as would otherwise occur due to the hull coming into contact with rocks, sand, etc., when beached.

The elastic anchor rope comprises an elastomeric core, which stretches during mooring to permit discharge of persons and items such as on a beach with subsequent retraction of the craft to an offshore location. A bow line permits retraction of the craft to the beach for loading purposes. After long periods of use of the rope it is not uncommon to find that the strands of the braided rope clamped about the elastic core have damaged the core by embedment of rope strands into the core.

One aspect of the invention is that it improves a braided anchor rope having an elastic core occupying a major portion thereof by providing two cord segments respectively attached to each of two ends of the core. Each of these cord segments has a respective first portion attached to a respective end of the elastic core and a respective second portion extending outwardly through the braided rope and disposed around an external surface of that braided rope so as to encircle it.

A further aspect of the invention is that it provides an anchor rope comprising a braided rope, a tubular elastic core and cords for transferring tensile loads from the core to the rope. The braided rope has first and second end portions and the tubular elastic core, which is disposed within the braided rope, extends between those end portions. Each of the two ends of the core is respectively connected to one of the end portions of the braided rope by a respective cord segment. A first, enlarged, portion of each cord segment is confined within the tubular core adjacent a respective end thereof by a respective ring disposed between the enlarged portion of the cord segment and the respective end of the tubular core. The second portion of each cord segment extends outwardly through the respective end portion of the braided rope and is secured around the rope.

Yet a further aspect of the invention is that it provides a method of making an elastic anchor rope. This method comprises providing a braided rope having an elastic core extending most of the way through it so as to define two end portions of the braided rope that do not have an elastic core; and attaching a respective cord between each of two ends of the elastic core and the respective proximal end portion of the braided rope.

Another aspect of the present invention is that it serves to isolate an elastic core from biased engagement with the strands of a braided rope within which the core is disposed. Preferred embodiments of the present invention provide this isolation by transferring tensile load from the elastic core to an intermediate cord and from that cord to a respective end portion of the braided outer rope.

Yet another aspect of the invention is that it dispenses with a metal ring that, in some prior art arrangements was clamped about the exterior of the braided rope to attach an elastic core to the rope. An external metal ring can mar a plastic surface.

Although it is believed that the foregoing rather broad summary description may be of use to one who is skilled in the art and who wishes to learn how to practice the invention, it will be recognized that the foregoing recital is not intended to list all of the features and advantages. Those skilled in the art will appreciate that they may readily use both the underlying ideas and the specific embodiments disclosed in the following Detailed Description as a basis for designing other arrangements for carrying out the same purposes of the present invention and that such equivalent constructions are within the spirit and scope of the invention in its broadest form. Moreover, it may be noted that different embodiments of the invention may provide various combinations of the recited features and advantages of the invention, and that less than all of the recited features and advantages may be provided by some embodiments.

DETAILED DESCRIPTION OF A PREFERRED EMBODIMENT

Figures 1, 2, 3, 4, 5, 6:
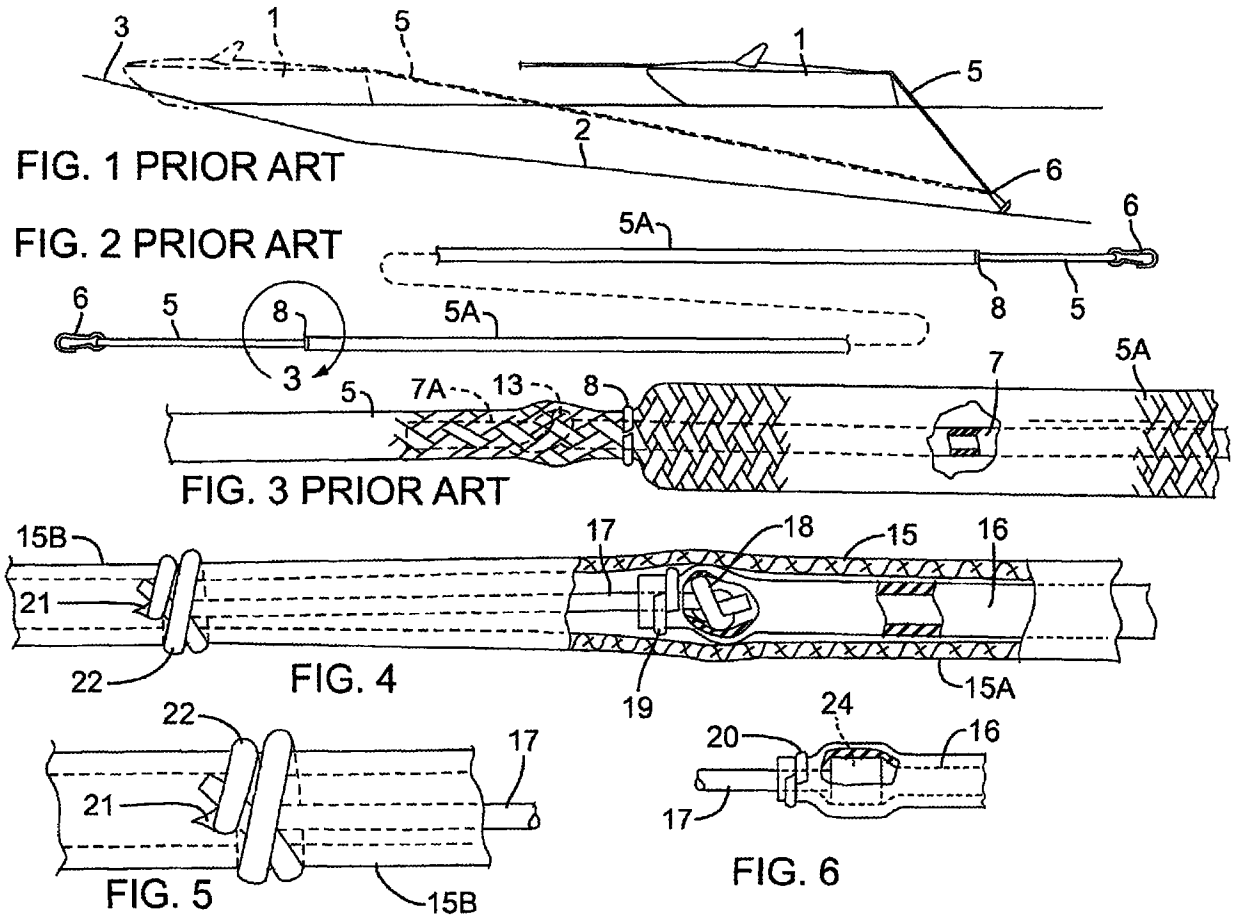
FIG. 1 PRIOR ART
FIG. 2 PRIOR ART
FIG. 3 PRIOR ART
FIG. 1 is a schematic view of a small watercraft anchored close to shore using an elastic anchor rope.
FIG. 2 is an elevational view of the elastic anchor rope disclosed in U.S. Pat. No. 5,483,911.
FIG. 3 is an elevational view of the end segment of the anchor rope disclosed in the above noted patent.
FIG. 4 is an elevational view of an end segment an embodiment of an anchor rope with fragments broken away.
FIG. 5 is an enlarged view of the external knot shown in FIG. 4.
FIG. 6 is a fragmentary view of a modified connection.

In studying this Detailed Description, the reader may be aided by noting definitions of certain words and phrases used throughout this patent document. Wherever those definitions are provided, those of ordinary skill in the art should understand that in many, if not most instances, such definitions apply to both preceding and following uses of such defined words and phrases.

In the drawings, reference numeral 15 identifies a segment of a braided anchor rope normally several feet in length. An elastic core at 16 of the rope may be of tubular latex and, in a relaxed state, contracts the rope resulting in the braided rope having an open or expanded cross section housing the elastic core 16. The rope main segment is at 15A while rope end segments are typically shown at 15B. The unseen end of the rope 15 would be a mirror image of the first end as seen in FIGS. 4 and 7.

In a first embodiment of the invention, as seen in FIG. 4, a tubular elastic core 16 is shown in endwise attachment to a braided rope 15 by a cord 17. A ring 19 closed about the end of the elastic core confines a first cord end which is enlarged, as by a knot 18. The cord 17 extends toward a proximal rope end and passes outwardly through an aperture 21 between filaments of the braided rope for external securement 22 to the rope 15. The cord 17 may be attached to elastic core 16 by a suitable knot as at 18 or by a collet as at 24 in FIG. 6. In this first embodiment the remaining end of the cord 17 may encircle and be attached to the rope exterior by a nail knot, which is commonly used by sport fishermen to secure a leader to a fly fishing line. Such a knot results in only a small irregularity in the rope surface. It will be recognized that other sorts of knots may be utilized to fix the cord 17 around a rope segment.

In the use of the first embodiment, as the cord 17 is tensioned, the knot 22 is tightened about the braided rope, thus transferring a tensile load from the elastic core to the cord and from the cord to the braided rope. Such indirect attachment of the elastic core 16 to the braided rope 15 prevents damage to the elastic core that can occur if the core is subjected to clamped engagement with the rope strands.

Figure 7:
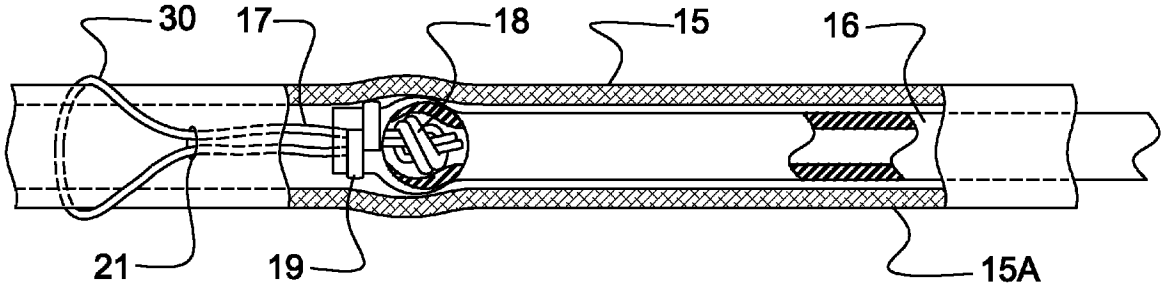
FIG. 7 is an elevational view of an end segment of a preferred embodiment of an anchor rope with fragments broken away.
Figure 8:
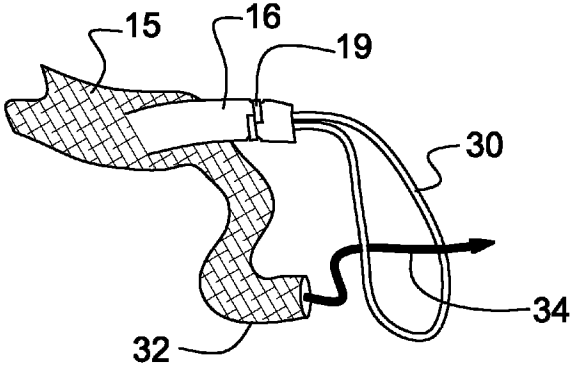
FIG. 8 is an elevational view of an end of a braided rope being passed through a loop in a cord segment.

In a second, preferred, embodiment, as depicted in FIG. 7, the cord 17 is formed into a loop 30, preferably by knotting the two ends of the cord together to form an enlarged portion. The knot 18 or other enlarged portion is preferably captured within the elastic core by a clamped ring 19. A portion of the loop 30 distal from the knot 18 is passed outwardly through an aperture 21 between strands of the braided rope 15, and an end 32 of the rope 15 is then passed through the loop 30, as indicated by the arrow 34 in FIG. 8. The distance between the end of the elastic core 16 and the opening 21 is selected so that when tension is applied between the end of the core and the proximal end of the rope, the loop snugly encircles the rope and provides even less of an irregularity on the rope surface than is found in the first embodiment discussed previously.

Those familiar with braided ropes will recognize that the aperture or opening 21 in the braided rope can be formed by spreading strands or filaments of the braid apart without having to cut or otherwise damage the rope.

Although the preferred embodiments discussed above employ knots captured within a tubular core to connect a cord to the core, many other approaches can be considered and fall within the scope of the invention. Enlarged regions of a cord suitable for capture within a tubular core also include the use of collets 24 and tightly looped and clamped cord ends. Spreading of the end of the elastic tubing for admission of the knot 18, collet 24, or other enlarged portion of the cord may be carried out by a spreader with multiple arms.

In use as an elastic anchor rope for small watercraft, an anchor is dropped perhaps twenty feet from shore, the watercraft is then momentarily beached for unloading while tethered to the extended anchor rope. Upon unloading, the rope automatically retrieves the watercraft to a safe offshore depth adjacent the beach. A bow line to the beach permits retrieval of the watercraft for boarding.

Although the present invention has been described with respect to several preferred embodiments, many modifications and alterations can be made without departing from the invention. Accordingly, it is intended that all such modifications and alterations be considered as within the spirit and scope of the invention as defined in the attached claims.

What is claimed is:

1. In a braided anchor rope having an elastic core occupying a major portion thereof, an improvement comprising two cord segments respectively attached to each of two ends of the core, each cord segment having a respective first portion attached to a respective end of the elastic core and a respective second portion extending outwardly through the braided rope and encircling an external surface thereof.

2. The improved anchor rope of claim 1 wherein the respective second portion of each cord segment comprises a respective second end portion knotted around the braided rope.

3. The improved anchor rope of claim 1 wherein the elastic core is tubular, the respective first portion of each cord segment comprises a respective first knot captured within the elastic core; and the respective second portion of each cord segment is knotted around the braided rope.

4. The improved anchor rope of claim 3 further comprising a respective clamp encircling each said first portion of each of said cord segments.

5. The improved anchor rope of claim 3 wherein the respective second portion of each of the cord segments comprises a respective nail knot.

6. The improved anchor rope of claim 1 wherein the respective second portion of each cord segment comprises a respective loop.

7. The improved anchor rope of claim 1 wherein the elastic core is tubular, and each cord segment comprises a respective loop formed by tying two ends of the respective cord segment together to form a respective knot captured within a respective end of the elastic core.

8. An anchor rope comprising:

a braided rope having two end portions;

a tubular elastic core disposed within the braided rope and extending between the end portions thereof, each of two ends of the core respectively connected to a respective one of the end portions of the braided rope by a respective cord segment; wherein each cord segment comprises:

a respective first portion captured within the tubular core adjacent a respective end thereof; and a respective second portion extending through and encircling a respective end portion of the braided rope.

9. The anchor rope of claim 8 wherein the second portion of each cord segment comprises a respective knot that tightens when the respective cord segment is tensioned.

10. The anchor rope of claim 8 wherein:

the respective first portion of each cord segment comprises the two ends thereof; and the respective second portion of each cord segment comprises a respective loop.

11. A method of making an elastic anchor rope, the method comprising the steps of:

providing a braided rope having a tubular elastic core extending through a major portion thereof so as to define two end portions of the braided rope not having an elastic core;

providing two cord segments, each having two respective ends;

capturing a first portion of each cord segment within a respective end portion of the elastic core;

passing a respective second portion of each cord segment through a respective end portion of the braided rope; and encircling each said end portion of the braided rope with the associated second cord segment portion.

12. The method of claim 11 wherein:

the first portion of each cord segment comprises a respective knot formed by tying the two ends of the respective cord segment together to form a respective cord loop;

the passing step comprises passing a portion of each cord loop outwards through a respective aperture formed between filaments of the respective end portion of the braided rope; and the encircling step comprises passing each respective end of the braided rope through the respective associated cord loop.

13. The method of claim 11 wherein:

the passing step comprises passing the respective second end of each cord segment outwards through a respective aperture formed between filaments of a respective end portion of the braided rope; and the encircling step comprises tying the respective second end of each cord segment around the respective end portion of the braided rope.

* * * * *

UNITED STATES PATENT AND TRADEMARK OFFICE

CERTIFICATE OF CORRECTION

PATENT NO. : 8,495,964 B1
APPLICATION NO. : 13/274311
DATED : July 30, 2013
INVENTOR(S) : Ronald N. Kubli It is certified that error appears in the above-identified patent and that said Letters Patent is hereby corrected as shown below:

On the Title Page

Items 12 and 76 – Inventor

Should read Ronald N. Kubli

Signed and Sealed this
Fifteenth Day of October, 2013

Teresa Stanek Rea

Teresa Stanek Rea
*Deputy Director of the United States Patent and Trademark Office*